United States Patent [19]

Lepreux

[11] 4,065,821

[45] Jan. 3, 1978

[54] ACOUSTIC BUOY

[75] Inventor: Guy Lepreux, Chevilly Larue, France

[73] Assignee: Compagnie Industrielle des Telecommunications Cit-Alcatel, Paris, France

[21] Appl. No.: 792,369

[22] Filed: Apr. 29, 1977

[30] Foreign Application Priority Data

May 7, 1976 France ..... 76.13748

[51] Int. Cl.[2] ..... B63B 21/52

[52] U.S. Cl. ..... 9/8 R

[58] Field of Search ..... 9/8 R; 244/138 R, 151 B; 340/2

[56] References Cited

U.S. PATENT DOCUMENTS

| | | | |
|---|---|---|---|
| 3,074,671 | 1/1963 | Dinolfo et al. | 9/8 R |
| 3,708,812 | 1/1973 | Yapoudjian et al. | 9/8 R |
| 3,921,120 | 11/1975 | Widenhofer | 9/8 R |

*Primary Examiner*—Trygve M. Blix
*Assistant Examiner*—Jesus D. Sotelo
*Attorney, Agent, or Firm*—Sughrue, Rothwell, Mion, Zinn and Macpeak

[57] ABSTRACT

An acoustic buoy which can be dropped from a plane, comprising a float connected to a plunger by a locking system. The shock of a parachute opening primes this locking system which is unlocked when the force applied to the system by the weight of the plunger decreases on the plunger being submerged. The system is unlocked even if the path of the buoy's fall is very oblique.

4 Claims, 9 Drawing Figures

ACOUSTIC BODY

FIELD OF THE INVENTION

The present invention relates to an acoustic buoy which can be dropped from a plane, the buoy comprising a float, a plunger and an air brake device connected to the float.

BACKGROUND OF THE INVENTION

In conventional buoys, the float is integral with a tube containing the plunger. The plunger is separated from its tube by the release of an end plate under the effect of the forces applied at the moment of impact with the water.

Now, the release can fail to take place when the buoy hits the water at too great an angle from the normal.

In the acoustic buoy according to the invention, the plunger is separated from the float even if the angle of incidence in relation to the surface of the water is very oblique at moment of impact.

SUMMARY OF THE INVENTION

The present invention provides an acoustic buoy which can be dropped from a plane and which comprises a float, a plunger and an air brake connected to the float, wherein the plunger is provided at its top with a casing which extends the wall of the float and in which the bottom part of the float can move piston-like. The bottom part of the float is provided with a bottom having a plurality of studs and is in the locked position and pushed down inside said casing and comprises bent spring blades. Each spring blade is fixed at a first end to a stud of the bottom of the float and has its second end inserted in an opening provided in the cylindrical casing at a higher level than that occupied by the first ends of the plates in the latched position. A spacer integral with the studs at points is situated just below the fixing points of the first ends of the spring blades, said spacer acting as a stop for the spring blades when the float rises above its locked position in the casing.

A blocking device when it is active prevents any pushing of the float into the casing. The spring blades in the locked position are extended and tend to push the float down into the casing. The blocking device is made passive as soon as the float rises above the locked position in the casing subsequent to the opening of the air brake device of the buoy. The length of the spring plates are such that when the spacer is pushed down into the casing until it touches a stop integral with the plunger and the second ends of the spring blades escape from the openings of the casing and thereby release the float from the plunger.

With this buoy the buoyancy of the plunger when in the water exerts a force which reduces the force applied to the spring blades so that the float sinks into the casing and the blades are released and thus allow the plunger to be separated from the float.

The shock when the buoy comes into contact with the water is not indispensable for the float to be separated from the plunger.

According to an improvement to the buoy according to the invention, this buoy may comprise a second elbowed spring blade whose first end is fixed to the same point of the stud as the first end of the first spring blade and whose second end is pressed against the inclined arm of the first spring blade.

According to a particular embodiment of the buoy according to the invention, the blocking device is constituted by small leaf springs each being jammed against a rim provided on the wall of the float, the actual wall of the float and the top of the casing.

According to a variant of the buoy according to the invention, the blocking device is constituted by a plurality of balls accomodated in recesses provided in the wall of the float and against which the top edge of the casing presses.

The invention will be better understood from the following description of embodiments of the invention given by way of example with reference to the accompanying drawings in which:

DESCRIPTION OF THE PREFERRED EMBODIMENTS

Figure 1:
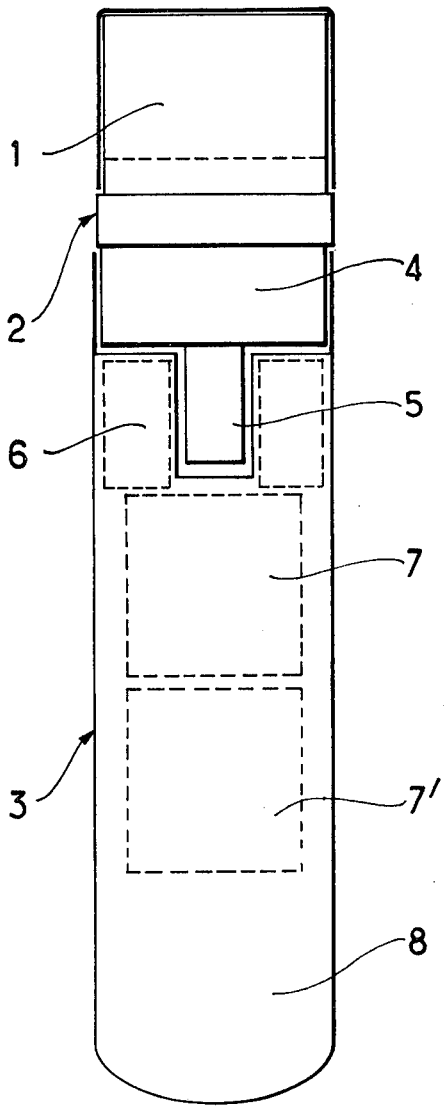
FIG. 1 is a diagrammatic side view of a buoy embodying the invention.

FIG. 1 shows an air-droppable acoustic buoy which embodies the invention. This cylindrically shaped buoy comprises, from top to bottom, a compartment 1 containing a parachute and an inflatable casing for supporting a float 2, the float 2 itself and plunger 3. The float 2 comprises a radio compartment 4 and a cylindrical battery 5. The plunger 3 comprises a toroidal compartment 6 surrounding the battery 5 and in which a coil of cable connecting the float 2 to the plunger 3 is wound.

The plunger 3 also includes a battery 7, an electronic package 7' and transducers 8 which are placed on the outside surface of the plunger.

The buoy also comprises a locking system between the float 2 and the plunger 3 which is shown in the following FIGS.

Figure 2:
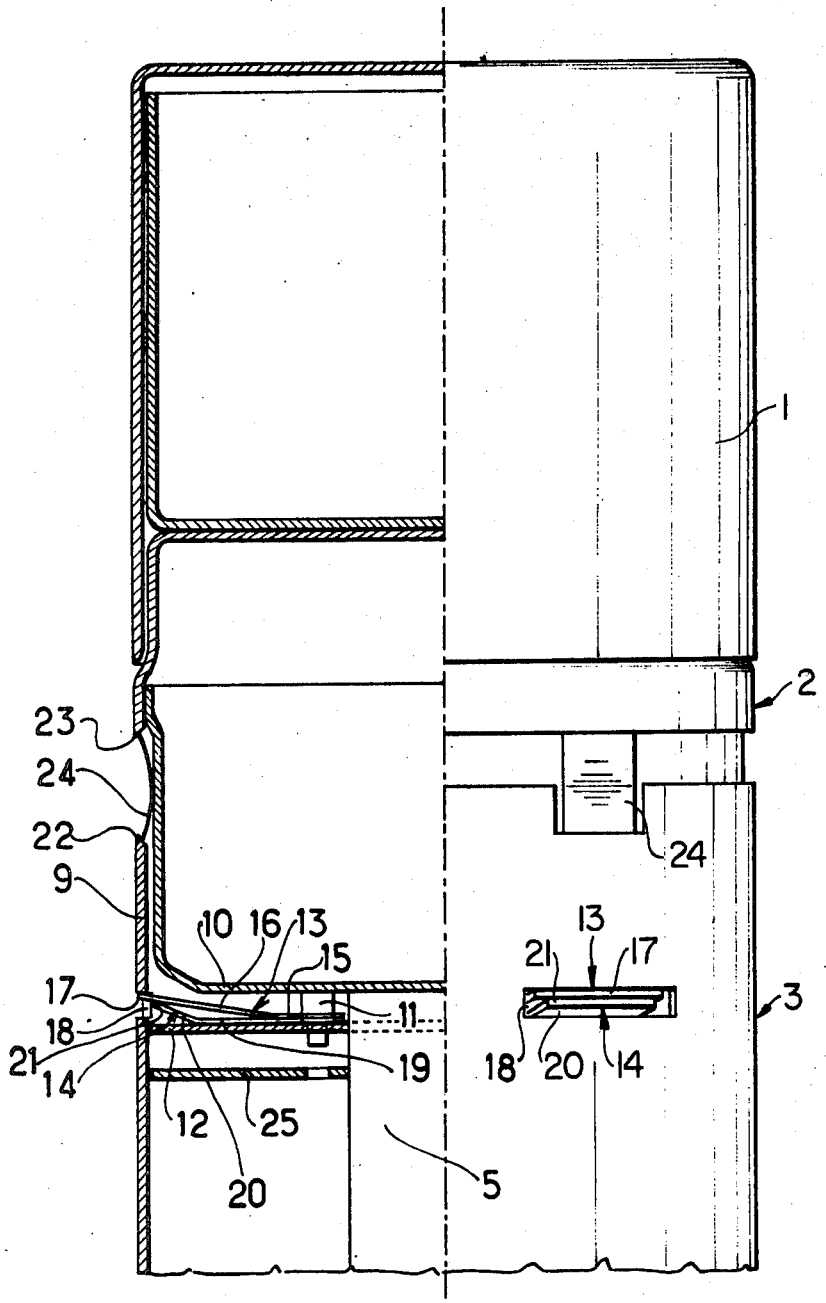
FIG. 2 is a partial cross-section of the top part of the buoy shown in FIG. 1.

FIG. 2 is a cross-section of the top of the buoy.

The lower part of the cylindrical float 2 is disposed inside a cylindrical casing 9 which is integral with the plunger 3 and which extends its interior wall.

The float 2 has a bottom 10 fitted with six studs 11. A Y-shaped spacer 12 is integral with the studs 11 which are spaced out regularly around a circle which has radius of half that of the periphery of the bottom of the float 2 and which has the same axis (see FIG. 3 which is a radial cross-section of the buoy at the level of the studs 11). The spacer 12 has a maximum diameter slightly smaller than the inside diameter of the casing 9.

Three pairs of spring blades 13 and 14 are fixed above the spacer 12, spaced circumferentially at 120° intervals. Each upper blade 13 is bent and comprises a horizontal arm 15 and an oblique arm 16, each blade 13 having one end fixed to two of the studs 11 while the other end 17 is fitted into one of three openings 18 provided in the casing 9.

Each lower blade 14 is also bent and comprises a horizontal arm 19 and an oblique arm 20. Each plate 14 also has one end fixed to two of the studs 11 and the other end 21 coming in contact with the bottom of the oblique arm 16 of the associated upper blade 13. The horizontal arms 19 rest on the spacer 12 and the horizontal arms 15 of the upper blades 13 rest on the horizontal arms 19 of the associated lower blades 14.

Leaf springs 24 which bear against the outside wall of the float 2 are disposed between the top 22 of the casing 9 and a rim 23 of the outside wall of the float 2.

In the rest position shown in FIG. 2, the lower spring blades 14 press hard against the oblique arms 16 of the upper spring blades 13. Thus, the float tends to be pushed into the casing 9. The float does not do this because the leaf springs 24 prevent it from being pushed in.

A stop 25 is provided in the plunger 3 and the spacer 12 abuts against it when the float is pushed into the casing 9.

The length of the upper spring blade 13 is chosen so that when the spacer 12 comes in contact with the stop 25, the upper blades 13 are released from the openings 18.

Figure 3:
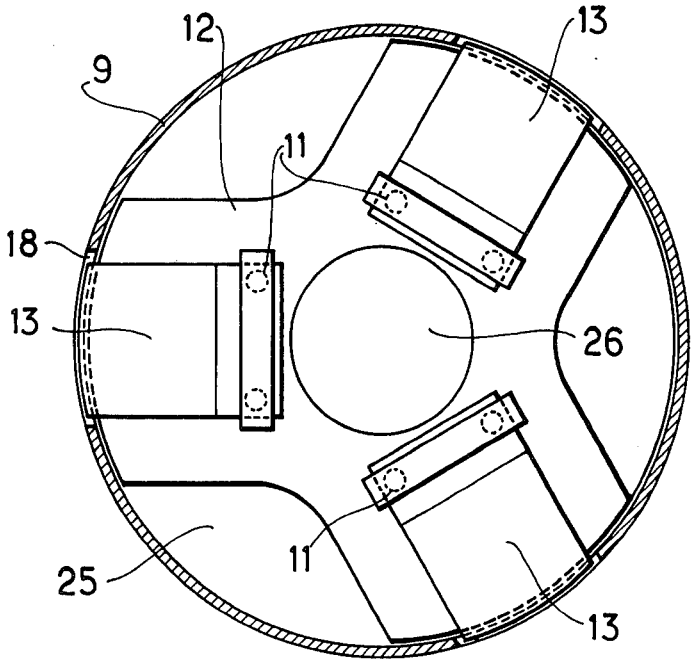
FIG. 3 is a radial cross-section of the buoy at the level of the legs of the float.

FIG. 3 is a radial cross-section of the buoy at the level of the studs 11.

The spacer 12 includes a central recess 26 through which the battery 5 passes.

Figure 4:
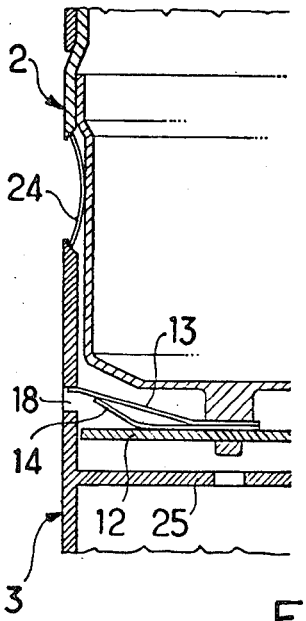
FIGS. 4, 5, 6, 7, 8 are vertical sections showing five respective positions of portions of the float and of the plunger of the buoy.
Figure 5:
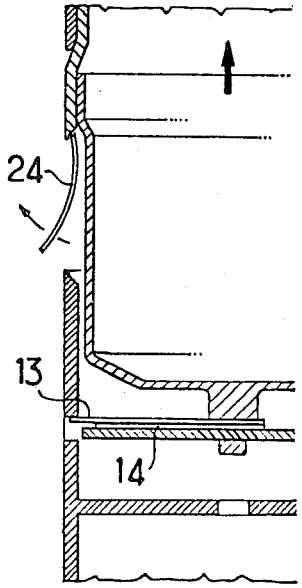
Figure 6:
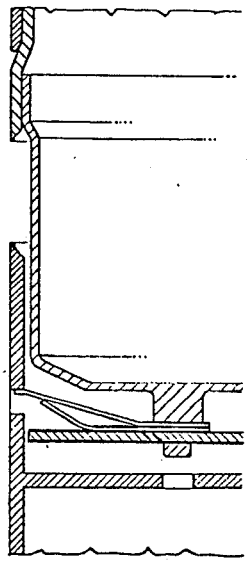

The operation of the locking system of the buoy according to the invention is illustrated in FIGS. 4 to 6.

FIG. 4 shows the various elements of the buoy in the rest position as they have already been shown in FIG. 2.

In FIG. 5, when the parachute unfolds, the float which is connected to the parachute receives a shock at the top and therefore tends to come out of the casing 9. This movement is blocked when the spring blades 13 and 14 are completely flattened on the spacer 12. The leaf springs 24 are then ejected.

FIG. 6 shows the position of the locking elements during the descent of the buoy once the parachute has unfolded. The spring blades 13 and 14 exert a force on the openings 18 of the casing 9 which counterbalances the force due to the weight of the plunger and to the oscillations of the buoy on the end of the parachute.

Figure 7:
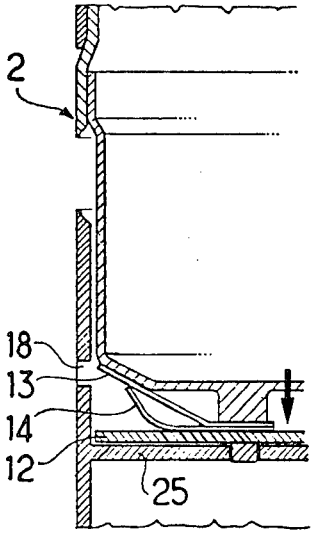

FIG. 7 shows the position of the locking elements when the buoy is submerged. When the buoy falls into the water, even if the direction of fall is not perpendicular to the surface of the water, the force exerted by the weight of the plunger on the blades 13 and 14 will decrease due to its bouyancy, whereupon, the float 3 is urged into the casing 9 by the blades 13 until the spacer 12 comes against the stop 25 and the blades 13 escape from the openings 18.

Figure 8:
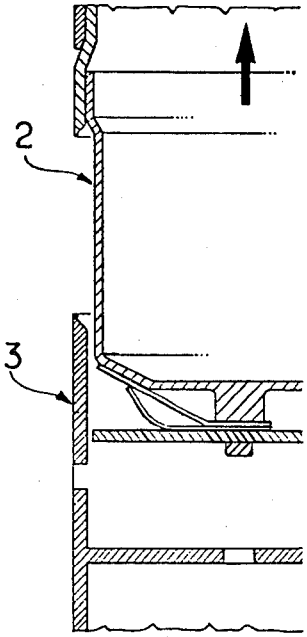

FIG. 8 shows the float 2 coming out of the casing 9, i.e. the descent of the plunger into the water when the blades 13 are no longer in the openings 18 and the plunger is no longer locked onto the float.

Figure 9:
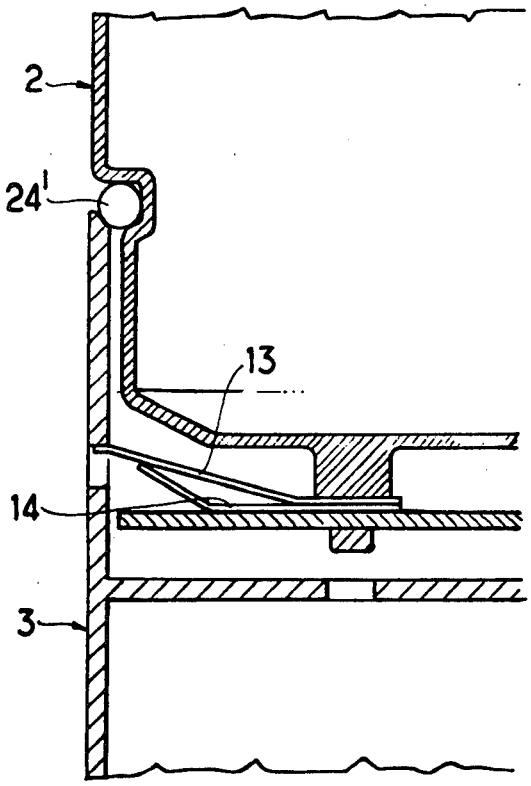
FIG. 9 is a vertical section showing a variant of portion of the buoy according to the invention

FIG. 9 shows a variant of the blocking device constituted by the leaf springs 24. These springs are replaced by balls 24'. The operation of this variant is identical to that of the shown in FIGS. 4 to 8. The balls are ejected when the parachute unfolds.

Although the acoustic buoy which has just been described appears to be the most advantageous for performing the invention, it will be understood that without going beyond the scope of the invention, some elements of this buoy can be replaced by others which are capable of fulfilling the same technical function or an equivalent technical function therein.

What we claim is:

1. An acoustic buoy which can be dropped from a plane, said buoy comprising a float, a plunger and an air brake connected to the float, said plunger being provided at its top with a casing which extends the wall of the float and in which the bottom part of the float moves piston-like, said bottom part of the float being provided with a bottom bearing a plurality of studs and normally being in the locked position and pushed down inside said casing, said bottom comprising bent spring blades, each spring blade being fixed at a first end to a stud of the bottom of the float and having its second end projecting within an opening provided in the cylindrical casing at a higher level than that occupied by the first ends of the blades in a latched position; a spacer integral with the studs at points situated just below the fixing points of the first ends of the spring blades, said spacer acting as a stop for the spring blades when the float rises above its locked position in the casing; a blocking device which when it is active prevents any pushing of the float into the casing, said spring blades in the locked position being extended and tending to push the float down into the casing, means for rendering said blocking device passive as soon as the float rises above the locked position in the casing subsequent to the opening of the air brake device of the buoy with the length of the spring blades being such that when the spacer is pushed down into the casing until it touches a stop integral with the plunger, the second ends of the spring blades escape from the openings of the casing to thereby release the float from the plunger.

2. An acoustic buoy according to claim 1, comprising a second elbowed spring blade whose first end is fixed to the same point of the stud as the first end of the first spring blade and whose second end is pressed against an inclined arm of the first spring blade.

3. An acoustic buoy according to claim 1, wherein the blocking device is constituted by small leaf springs, each small leaf spring being jammed against a rim provided on the wall of the float, the actual wall of the float and the top of the casing.

4. An acoustic buoy according to claim 1, wherein said blocking device is constituted by a plurality of balls accomodated in recesses provided in the wall of the float and against which the top edge of the casing presses.

* * * * *